US007021493B2

(12) United States Patent
Brickwood

(10) Patent No.: US 7,021,493 B2
(45) Date of Patent: Apr. 4, 2006

(54) DISPENSING DISPLAY CONTAINER FOR LOTTERY TICKETS

(75) Inventor: Michael John Brickwood, Winnipeg (CA)

(73) Assignee: Pollard Banknote Limited, Winnipeg (CA)

( * ) Notice: Subject to any disclaimer, the term of this patent is extended or adjusted under 35 U.S.C. 154(b) by 542 days.

(21) Appl. No.: 10/408,773

(22) Filed: Apr. 8, 2003

(65) Prior Publication Data

US 2004/0200854 A1 Oct. 14, 2004

(51) Int. Cl.
*A47F 1/04* (2006.01)

(52) U.S. Cl. ..... 221/305; 206/39.6

(58) Field of Classification Search ..... 221/33, 221/45, 305; 206/39, 39.6
See application file for complete search history.

(56) References Cited

U.S. PATENT DOCUMENTS

| | | | | |
|---|---|---|---|---|
| 3,083,866 | A | 4/1963 | Strange | |
| 4,032,004 | A * | 6/1977 | Coates | 206/39.6 |
| 6,267,262 | B1 | 7/2001 | Wilner | |

FOREIGN PATENT DOCUMENTS

| | | |
|---|---|---|
| CA | 53463 | 10/1984 |

* cited by examiner

*Primary Examiner*—Kenneth Noland
(74) *Attorney, Agent, or Firm*—Adrian D. Battison; Michael R. Williams; Ryan W. Dupuis

(57) ABSTRACT

Lottery tickets are dispensed to the public for sale by providing a flat blank of a foldable cardboard material which can be erected to form a disposable container shaped to receive only the fan folded stack of the tickets. An opening in a front wall is formed with a horizontal dispensing slot and a vertical slot. The outside of the container is printed with the same game graphics as the tickets. The container is dedicated only to the particular game and can be used as a single use dispensing container for unusual shape tickets or for promoting new games.

15 Claims, 3 Drawing Sheets

FIG. 1
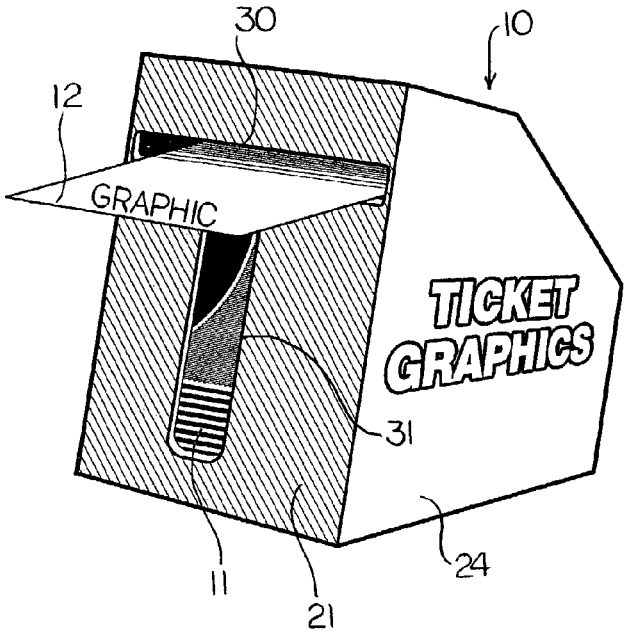
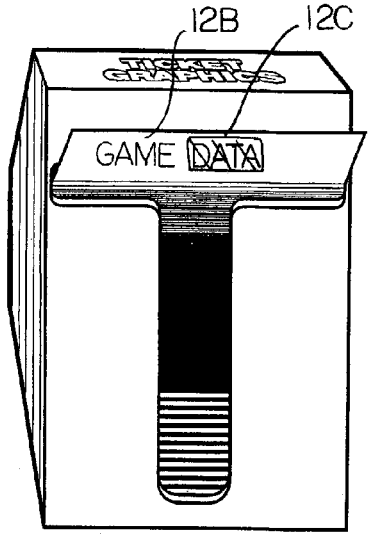
FIG. 2
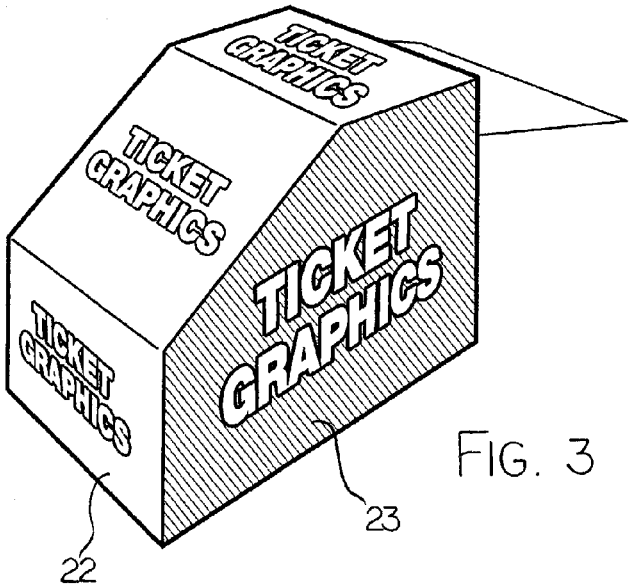
FIG. 3

DISPENSING DISPLAY CONTAINER FOR LOTTERY TICKETS

This invention relates to a combination of a container and a supply of lottery tickets arranged for display and dispensing at a point of sale and to a method for dispensing lottery tickets.

BACKGROUND OF THE INVENTION

In many retail establishments, lottery tickets are sold from dispensing machines. Some such machines are stand alone machines which are intended to interact solely with the public so that they include mechanisms for receiving payment and for controlling the dispensing of selected tickets. Such machines generally have a series of containers which receive a supply of the tickets to be dispensed together with a roller dispensing mechanism which feeds the tickets from the supply to a dispensing location. In such machines it is necessary to provide a bursting mechanism which separates each ticket from the next along a line of weakness. Such tickets are generally supplied in fan-folded stacked form.

Other such machines are of a similar nature with the exception that the tearing action is carried out by the customer where the tear line is presented at a nip point of the machine so that the customer can tear away one or more tickets which have been presented forwardly of the nip line.

Other dispensing mechanisms are provided for interaction between the customer, the clerk in the retail establishment and the machine in that the machine is basically a storage and dispensing assistant for the clerk allowing the clerk to pull out and tear off a required number of tickets for the customer, at the customers request. Some such machines include electronic communication so that the customer and clerk can both provide inputs into the machine confirming the discharge of selected tickets. Other machines are simply a receptacle for the supplies of different tickets with the clerk pulling out the required number of tickets as selected by the customer.

The intention with such machines is generally to provide a number of compartments which store tickets in sufficient numbers to provide a selection for the customers. The machines are therefore not associated with particular tickets or particular games but must be designed so that they can accommodate different sizes and types of tickets for dispensing. This requirement to co-ordinate the machine and ticket size places limitations on ticket designs in that the tickets must be sized and shaped so that they can be accommodated within the existing dispensing machines.

Yet further the fact that the machines are designed to receive different tickets means that the machines can not carry extensive advertising or graphics materials promoting the games since this must be changed if the tickets are changed. In many cases, therefore, the machine displays one or more of the tickets so that the customer can see the tickets to be selected so that the ticket itself constitutes the advertising material presented on the machine.

These two limitations thus restrict the entry into the market place of new games since new games may be dimensioned differently from existing games and since new games require additional promotion for the customers to become aware of them. However the presentation of new and more exciting games is desirable for the promotion of the industry in general.

SUMMARY OF THE INVENTION

It is one object of the invention to provide an improved dispensing container for lottery tickets and an improved method using the dispenser.

According to one aspect of the invention there is provided a method of dispensing lottery tickets comprising:

providing a supply of lottery tickets each having a lottery game thereon;

each lottery ticket having printed thereon lottery game indicia of the lottery game which indicia are covered by a removable covering allowing a player to remove the covering and expose the indicia for playing the game;

each lottery ticket having printed thereon game graphics identifying the lottery game;

providing a dispensing container shaped and arranged to contain the supply within a hollow interior of the container;

providing on the dispensing container an opening arranged for dispensing through the opening of the lottery tickets from within the container for sale to the player;

and supplying the dispensing container as at least one flat blank of foldable sheet material and erecting the at least one flat blank of foldable sheet material to form the dispensing container with said hollow interior and said opening for receiving the supply.

Preferably said at least one blank comprises a single flat blank shaped and arranged to define the enclosed container but the structure may be formed from more than one piece or blank which can be assembled together to complete the container. The blank may be simply a flat sheet which is then folded along pre-set or scored lines to form the container, or the blank may be already assembled or connected at certain locations and folded flat for transportation and then merely pulled to the required erected condition. It will be appreciated that many different arrangements of box formation can be used as is well known to one skilled in the art to form the relatively simple container and the particular shape or formation of the folded structure is not a substantial part of the present invention.

Preferably the supply comprises a stack of the tickets and in most cases this will be a fan folded stack of the tickets, although other supply structures such as a roll can also be used.

Preferably the dispensing opening comprises a horizontal slot in an upstanding wall of the container, the width of the slot being arranged to allow the passage therethrough of the width of the ticket. The slot is a simple construction with no provision of a mechanical bursting device nor of a device for holding a tickets at the line of weakness. Thus the separation at the line of weakness is merely left to the clerk to tear the tickets one from the next, after the line of weakness has been exposed from the container. Thus the dispensing container is of a simple inexpensive construction allowing it to be disposable.

In order to form the container simply, it preferably contains no rollers or guides and the tickets from the fan folded strip are simply pulled through the slot. However in the event that the end ticket falls back or is pushed back into the container, preferably, the dispensing opening includes a vertical slot in the upstanding wall intersecting the horizontal slot and extending toward a bottom wall of the container to allow a ticket from the supply to be lifted to the horizontal slot.

Preferably the container has a top lid which can be opened for loading the supply of tickets.

Preferably the container has a base connected to upstanding front, rear and side walls dimensioned to receive substantially only the outside dimensions of a ticket lying thereon. Thus the container is shaped and arranged to receive a specific size of ticket and can be designed for unusual shapes as it is dedicated to that ticket. The container has only one receptacle or compartment defined solely by the outer walls for the single supply of tickets. The height of the side walls is arranged substantially to receive only a supply of tickets of suitable height. The height may greater than a single book of fan folded tickets to allow one or more additional books to be connected end to end, using the conventional perforated connecting tape. In this way a second back up book of tickets can be connected into the supply and contained within the container before the first book is exhausted.

Preferably the container has printed on an outside surface thereof the game graphics identifying the lottery game. Thus the container is dedicated to the specific ticket and can be covered with highly attractive multi-coloured graphics advertising the specific ticket. When the ticket is no longer intended to be sold or is withdrawn from the market, the dedicated container with its graphics can be discarded in view of its simple economic construction.

It is primarily intended that the container is supplied to a dispensing location in flat form and assembled at the location for receiving the supply of lottery tickets therein.

Preferably the container is formed from cardboard, although other sheet materials may be employed.

The type of lottery tickets is not intended to be limited to scratch-off type, variable image tickets and other types may also be dispensed using a container of this type. These may include break-opens, mixed break-open and scratch-off and others as may be available to one skilled in the art.

According to a second aspect of the invention there is provided a combination comprising:

a supply of lottery tickets each having a lottery game thereon;

each lottery ticket having printed thereon lottery game indicia of the lottery game which indicia are covered by a removable covering allowing a player to remove the covering and expose the indicia for playing the game;

each lottery ticket having printed thereon game graphics identifying the lottery game;

and a dispensing container for containing the supply within a hollow interior of the container;

the dispensing container an opening arranged for dispensing through the opening of the lottery tickets from within the container for sale to the player;

the dispensing container comprising a flat blank of foldable sheet material which is shaped and arranged so that when erected it forms bottom, top, front, rear and side walls defining the dispensing container with said hollow interior for receiving the supply;

the dispensing container having printed on an outside surface of the sheet material the game graphics identifying the lottery game.

The purpose of the combination disclosed herein is to provide Lotteries with an alternative to the current plastic ticket dispensers. The benefits of this dispenser when compared to the plastic dispensers are:

a) low cost per unit;

b) it can be designed to dispense non-standard tickets such as die-cuts, odd sized tickets, pouched tickets, ACTION PACK, DOUBLE PLAY, VARIABLE IMAGED BREAK OPENS, this allows the Lotteries the flexibility to merchandise a more diverse product mix;

c) because of the low cost per unit it can be disposable so that it can be used for the one of a kind tickets then thrown away after ticket is off market;

d) it can be used for experimental tickets in a small controlled area, following which, if the ticket is to become a regular product line the lottery can then develop more permanent dispensers;

e) the dispensers can be printed with game specific graphics, this can serve as a marketing tool to highlight extra play features or new products;

f) it can serve as an innovative point of sale option for Lotteries;

g) it can be displayed in a variety of positions to help better use of counter space at the retailer.

BRIEF DESCRIPTION OF THE DRAWINGS

One embodiment of the invention will now be described in conjunction with the accompanying drawings in which:

FIG. 1 is an isometric view of the combination of dispensing container and stack of lottery tickets according to the present invention, taken from the front and one side.

FIG. 2 is an isometric view of the combination of dispensing container and stack of lottery tickets of FIG. 1, taken from the front and the other side.

FIG. 3 is an isometric view of the combination of dispensing container and stack of lottery tickets of FIG. 1, taken from the rear and other side.

In the drawings like characters of reference indicate corresponding parts in the different figures.

DETAILED DESCRIPTION

A combination for dispensing lottery tickets is shown in FIGS. 1 to 4 in which there is shown a dispensing container 10 including a supply 11 of tickets 12.

The ticket supply 11 provides a stack of fan-folded tickets having a row of tickets 12 connected together but separable along lines of weakness 13. Normally the fan-folded arrangement provides the folding action at the lines of weakness so that the stack has a length equal to the length of one ticket. However it is also possible that the length of the stack may include a plurality of tickets depending upon the length of the individual tickets and the required dimensions of the container.

However other forms of supply may also be used including a stack of individual or separate tickets or including even a roll of tickets although this is not commonly used in the industry.

The tickets can be of many different types including tickets formed of a single sheet printed on both surfaces, tickets formed of laminated sheets including two or more sheets, tickets contained within a laminated pouch and others which are known to one skilled in the art.

In the example shown the ticket has an upper surface 12A on which is printed ticket graphics and a lower 12B on which is printed game data. However this is merely an example and it is well known the tickets may include printed information in various locations on the tickets. In the example shown the ticket graphics includes promotional information and game playing information with the intention of advertising the ticket to the customer. In the example shown the game data is the printing of the game itself which generally includes a covering material 12C over some or all of the game data which allows the playing of the game. Thus the customer after purchasing a ticket based upon the ticket graphics, turns to the game data to play the actual game by scratching away or otherwise removing the coating or covering 12C to expose some of the game data previously covered allowing the game to be played and the winning or losing nature of the ticket revealed.

Figure 4:
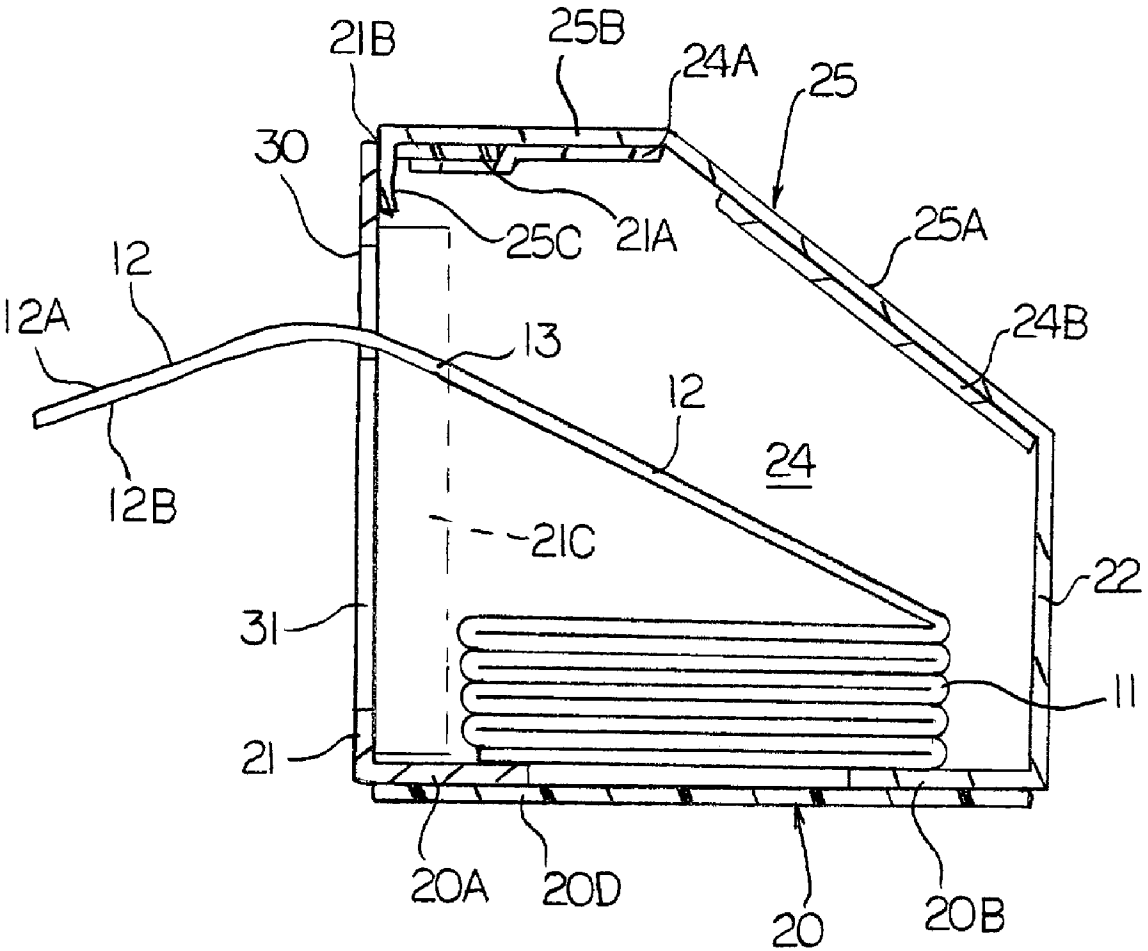
FIG. 4 is a cross-sectional view of the combination of dispensing container and stack of lottery tickets of FIG. 1, taken on the lines 4—4.
Figure 5:
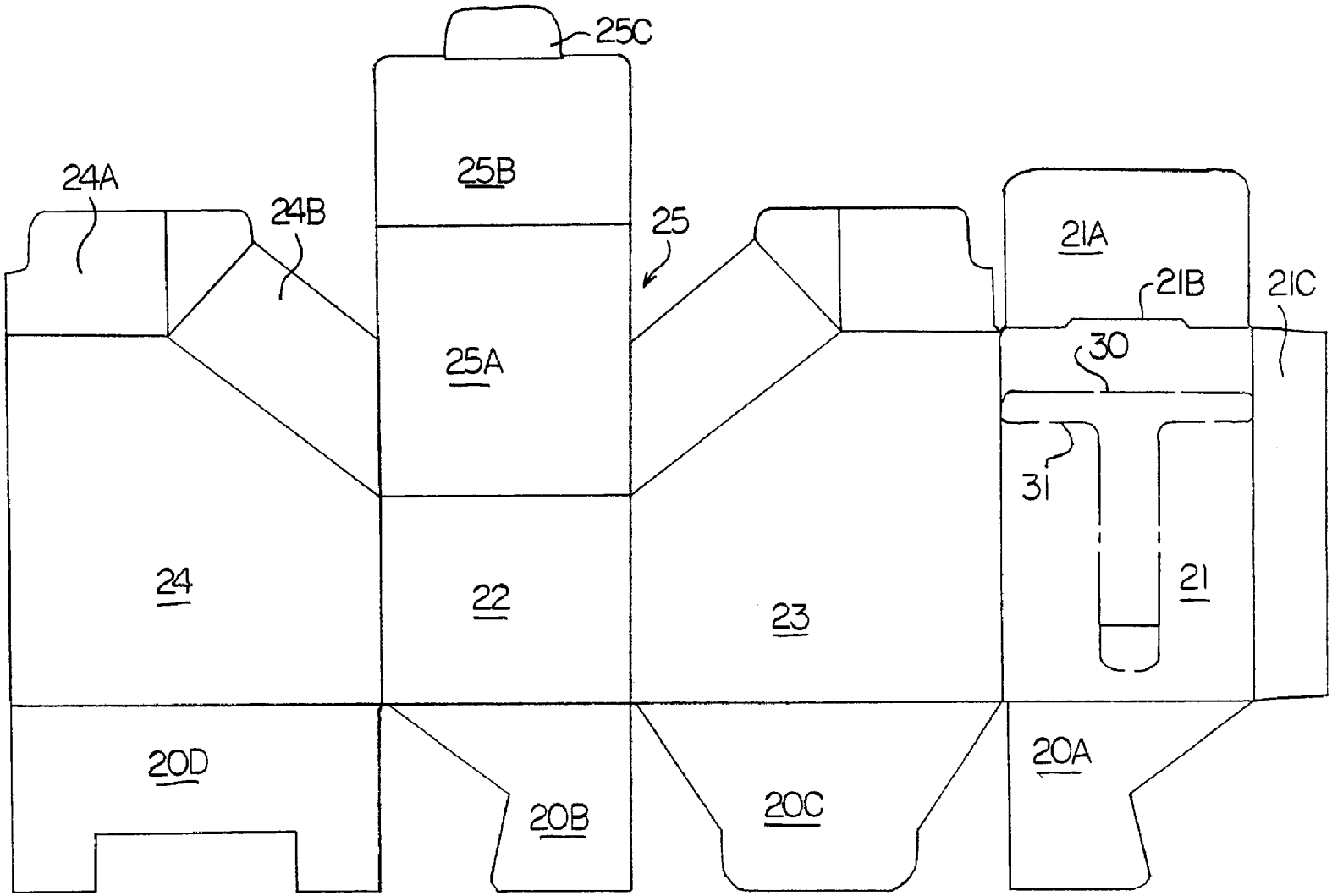
FIG. 5 is a top plan view of the dispensing container of FIG. 1 showing the blank in flat form.

The container 10 is formed from a blank of sheet material, as shown in FIG. 5, which can be folded and connected to form the closed container structure shown in FIGS. 1 through 4.

In one example, the blank may be preconnected and preformed and simply collapse to a flat condition allowing it to be extended by the clerk in the point of sales location by twisting the structure so that it moved from a flat condition to the generally rectangular condition shown in FIGS. 1 through 4.

In another alternative, as shown in FIG. 5, the blank may be formed simply as a flat sheet which is die-cut to a required shape and to form weakened fold lines with instructions for the clerk as to the directions of folding and the finished tucking of flanges into certain portions of the container so as to form a rigid structure which is self supporting and retains its rectangular shape and its hollow interior.

It will be apparent that the formation of boxes from blanks is a well established art and many different techniques are available to provide different shapes of box and to provide different levels of stability and structural strength as required for the particular product concerned. The blank shown in FIG. 5 is therefore merely one example which can be folded to form the container shown in FIGS. 1 through 4.

The container thus comprises a bottom wall or base 20, a front wall 21, a rear wall 22, side walls 23 and 24, all of which stand vertically upwardly from the base so as to form a generally rectangular container. A top wall 25 can be merely horizontal but in the example shown includes an inclined rear section 25A and a shorter horizontal top section 25B simply for an improved appearance so the container does not merely appear as a simple rectangular box. Yet further modifications to the shape can be provided using the conventional knowledge of the box maker to provide a box having particularly attractive appearance in view of its intentions as a promotional tool for the tickets concerned.

One or more of the surfaces of the container has printed thereon ticket graphics identical to or corresponding to or related to the ticket graphics from the surface 12A of the tickets. Thus the ticket graphics both on the ticket itself and the container provide a promotional material intending to advertise the product to the customer and to give the customer sufficient information concerning the nature of the game to encourage the customer to purchase that game.

The sheet material from which the container is formed is preferably cardboard since this is relatively inexpensive and provides material which can be readily folded to provide the required structural strength. In addition the cardboard provides surfaces which can receive multicoloured graphics for the required attractive appearance. However other sheet materials can also be used which provide the same above characteristics.

The size of the base is such that it has a width substantially equal to the width of the ticket and a length substantially equal to the length of the tickets or the length of the fan-folded stack so that the tickets are received within the container through the opening of the top and then the stack of tickets substantially fill the container. Thus the container is dimensioned to match the dimensions of the ticket so that a particularly large or particularly unusually dimensioned ticket can be accommodated within a box of the same dimensions. The container has only a single compartment or receptacle for only a single ticket since the container is intended to advertise the particular ticket concerned and to be dedicated solely to that particular ticket.

The container has no mechanism for dispensing the ticket in that it has no rollers nor any other device to drive the ticket through an open slot 30 in the front wall 21. Thus the container is inexpensive since it has for the removal of ticket merely the slot without the addition of any motors or any other mechanism for driving tickets from the container. In addition the container has no bursting mechanism nor any nip mechanism which holds the tickets for bursting. Instead it is intended merely that the container provide a leading edge of the first ticket as shown in the figures which allows the clerk to pull that leading edge to extract the required number of tickets and then the clerk manually tears across the line of weakness 13 at the required location to separate the required number of tickets from the supply.

Thus the container is of the minimum necessary construction to provide merely the containing walls and the slot which allows the tickets to be extracted.

In case the leading ticket falls back into the container by gravity, an additional vertical slot 31 is provided extending downwardly from the horizontal slot 30 to a position adjacent the base 20 so as to allow the clerk simply to place a finger into the vertical slot 31 and lift up the leading ticket and pull it through the slot 30 for dispensing.

As the tickets have a width substantially equal to the width of the container, the slot 30 also extends across substantial the full width of the front face 21.

The disposable container thus formed can be dedicated to the tickets to be sold and thus acts to provide advertising material for those tickets. In this way new games requiring additional promotion can utilise the dedicated container as the promotional material. In addition tickets can be developed which have shapes which cannot normally be dispensed using conventional machines since the container is manufactured and arranged so that it matches the shape of the ticket concerned. Thus the lotteries are able to introduce new games and particularly new games having unusual shapes of tickets in a manner which allows those new games to be promoted more effectively and thus obtain new customers.

In addition the dispensing container is manufactured in a manner which allows it to be of sufficiently inexpensive construction that it can be simply discarded after the particular promotion is over. At this time the ticket may become an established ticket dispensed through the existing conventional dispensing machines or maybe simply discarded if it is unsuccessful or is of a time limited nature.

The example of a suitable blank shown in FIG. 5 can be modified in many ways using the knowledge of persons skilled in the manufacture of collapsible boxes. In the blank, the base 20 is formed from four flap pieces 20A to 20D each connected by a fold line to the bottom edge of a respective one of the side panels 21, 22, 23 and 24. These flap pieces 20A to 20D are shaped to provide an interconnection which holds the pieces connected together when the box is assembled thus maintaining the box in its rectangular construction. The rear wall 22 is attached to the top piece 25 at a fold line. The top piece includes the inclined section 25A, the horizontal section 25B and a turn down flap 25C which tucks into a slot 21B at the junction between the front wall 21 and a flap 21A attached at a top edge thereof. The side wall 24 includes a flap 24A connected to a top edge of the side wall 24 which when folded underlies the horizontal top portion 25B and a flap 24B also connected to a top edge of the side wall 24 which when folded underlies the inclined top portion 25A. The side walls 24 and 23 are symmetrical so that the side wall 23 includes similar top flaps. A flap 21C along the side edge of the front wall 21 lies inside the side wall 24 when folded.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of dispensing lottery tickets comprising:

providing a supply of lottery tickets each having a lottery game thereon;

each lottery ticket having printed thereon lottery game indicia of the lottery game which indicia are covered by a removable covering allowing a player to remove the covering and expose the indicia for playing the game;

each lottery ticket having printed thereon game graphics identifying the lottery game;

providing a dispensing container shaped and arranged to contain the supply within a hollow interior of the container;

providing on the dispensing container an opening arranged for dispensing through the opening of the lottery tickets from within the container for sale to the player;

and supplying the dispensing container as at least one flat blank of foldable sheet material and erecting the at least one flat blank of foldable sheet material to form the dispensing container with said hollow interior and said opening for receiving the supply.

2. The method according to claim 1 wherein said at least one blank comprises a single flat blank shaped and arranged to define the enclosed container.

3. The method according to claim 1 wherein the supply comprises a stack of the tickets.

4. The method according to claim 1 wherein the supply comprises a fan folded stack of the tickets.

5. The method according to claim 1 wherein the dispensing opening comprises a horizontal slot in an upstanding wall of the container, the width of the slot being arranged to allow the passage therethrough of the width of the ticket.

6. The method according to claim 1 wherein the dispensing opening includes a vertical slot in the upstanding wall intersecting the horizontal slot and extending toward a bottom wall of the container to allow a ticket from the supply to be lifted to the horizontal slot.

7. The method according to claim 1 wherein the container has a top lid which can be opened for loading the supply of tickets.

8. The method according to claim 1 wherein the container has a base dimensioned to receive substantially only a ticket lying thereon and a height substantially to receive the stack of tickets.

9. The method according to claim 1 wherein the container has printed on an outside surface thereof the game graphics identifying the lottery game.

10. The method according to claim 1 wherein the container is supplied to a dispensing location in flat form and assembled at the location for receiving the supply of lottery tickets therein.

11. The method according to claim 1 wherein the container is formed from cardboard.

12. A combination comprising:

a supply of lottery tickets each having a lottery game thereon;

each lottery ticket having printed thereon lottery game indicia of the lottery game which indicia are covered by a removable covering allowing a player to remove the covering and expose the indicia for playing the game;

each lottery ticket having printed thereon game graphics identifying the lottery game;

and a dispensing container for containing the supply within a hollow interior of the container;

the dispensing container an opening arranged for dispensing through the opening of the lottery tickets from within the container for sale to the player;

the dispensing container comprising a flat blank of foldable sheet material which is shaped and arranged so that when erected it forms bottom, top, front, rear and side walls defining the dispensing container with said hollow interior for receiving the supply;

the dispensing container having printed on an outside surface of the sheet material the game graphics identifying the lottery game.

13. The combination according to claim 12 wherein the supply comprises a fan folded stack of the tickets.

14. The combination according to claim 13 wherein the dispensing opening comprises a horizontal slot in an upstanding wall of the container, the width of the slot being arranged to allow the passage therethrough of the width of the ticket and a vertical slot in the upstanding wall intersecting the horizontal slot and extending toward a bottom wall of the container to allow a ticket from the supply to be lifted to the horizontal slot.

15. The combination according to claim 13 wherein the container has a base dimensioned to receive substantially only a ticket lying thereon and a height substantially to receive the stack of tickets.

* * * * *